US009279172B2

(12) United States Patent
Kato et al.

(10) Patent No.: US 9,279,172 B2
(45) Date of Patent: Mar. 8, 2016

(54) HEAT-RESISTANCE FERRITIC STAINLESS STEEL

(75) Inventors: Yasushi Kato, Chiba (JP); Norimasa Hirata, Aichi (JP); Tetsuyuki Nakamura, Chiba (JP); Takumi Ujiro, Chiba (JP); Hiroki Ota, Chiba (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 12/664,705

(22) PCT Filed: Mar. 5, 2009

(86) PCT No.: PCT/JP2009/054706

§ 371 (c)(1),
(2), (4) Date: Jan. 13, 2010

(87) PCT Pub. No.: WO2009/110640

PCT Pub. Date: Sep. 11, 2009

(65) Prior Publication Data

US 2011/0008200 A1 Jan. 13, 2011

(30) Foreign Application Priority Data

Mar. 7, 2008 (JP) ..... 2008-057518

(51) Int. Cl.
*C22C 38/20* (2006.01)
*C22C 38/22* (2006.01)
(Continued)

(52) U.S. Cl.
CPC ..... *C22C 38/26* (2013.01); *C21D 6/002* (2013.01); *C22C 38/001* (2013.01); *C22C 38/004* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/28* (2013.01); *C21D 2211/005* (2013.01); *F01N 2530/04* (2013.01)

(58) Field of Classification Search
CPC ..... C22C 38/40; C22C 38/42; C22C 38/44; C22C 38/46; C22C 38/48; C22C 38/50; C22C 38/52; C22C 38/54
USPC ..... 148/325, 326, 332; 420/34, 60, 62, 70, 420/89, 90, 103, 127
See application file for complete search history.

(56) References Cited

U.S. PATENT DOCUMENTS 4,331,474 A * 5/1982 Espy ..... 420/57
6,673,166 B2 * 1/2004 Oku et al. ..... 148/326
(Continued)

FOREIGN PATENT DOCUMENTS

JP 2000-297355 A 10/2000
JP 2001-316773 A 11/2001
(Continued)

OTHER PUBLICATIONS

Computer-generated translation of JP 2006-009056 (Nishida et al.), published in the Japanese language on Jan. 12, 2006.*

*Primary Examiner* — Scott Kastler
*Assistant Examiner* — Vanessa Luk
(74) *Attorney, Agent, or Firm* — RatnerPrestia

(57) ABSTRACT

Ferritic stainless steel is excellent in terms of both oxidation resistance and thermal fatigue resistance without adding expensive elements, such as Mo or W. The ferritic stainless steel, contains: C: 0.015 mass % or lower, Si: 1.0 mass % or lower, Mn: 1.0 mass % or lower, P: 0.04 mass % or lower, S: 0.010 mass % or lower, Cr: 16 to 23 mass % or lower, N: 0.015 mass % or lower, Nb: 0.3 to 0.65 mass %, Ti: 0.15 mass % or lower, Mo: 0.1 mass % or lower, W: 0.1 mass % or lower, Cu: 1.0 to 2.5 mass %, Al: 0.2 to 1.5 mass %, and the balance of Fe and inevitable impurities.

11 Claims, 4 Drawing Sheets

(51) Int. Cl.

| | |
|---|---|
| ***C22C 38/26*** | (2006.01) |
| ***C22C 38/28*** | (2006.01) |
| ***C22C 38/06*** | (2006.01) |
| ***C22C 38/02*** | (2006.01) |
| ***C22C 38/04*** | (2006.01) |
| ***C22C 38/00*** | (2006.01) |
| ***C22C 38/24*** | (2006.01) |
| ***C21D 6/00*** | (2006.01) |

(56) References Cited

U.S. PATENT DOCUMENTS

| | | | | |
|---|---|---|---|---|
| 2001/0032687 | A1* | 10/2001 | Antoni et al. | 148/531 |
| 2002/0074067 | A1* | 6/2002 | Ota et al. | 148/610 |
| 2002/0117239 | A1* | 8/2002 | Oku et al. | 148/607 |
| 2004/0096351 | A1* | 5/2004 | Suzuki et al. | 420/60 |
| 2004/0137232 | A1* | 7/2004 | Yazawa et al. | 428/418 |

FOREIGN PATENT DOCUMENTS

| | | | | | |
|---|---|---|---|---|---|
| JP | 2004-018921 | A | | 1/2004 | |
| JP | 2004-307918 | A | | 11/2004 | |
| JP | 2005-187857 | A | | 7/2005 | |
| JP | 2005-314740 | A | | 11/2005 | |
| JP | 2006-009056 | | * | 1/2006 | C22C 38/00 |
| JP | 2006-117985 | A | | 5/2006 | |
| JP | 2007-314837 | | * | 12/2007 | C22C 38/00 |
| JP | 2008-285693 | | * | 11/2008 | C22C 38/00 |
| JP | 2008-285693 | A | | 11/2008 | |
| WO | 03/004714 | A1 | | 1/2003 | |

* cited by examiner

HEAT-RESISTANCE FERRITIC STAINLESS STEEL

RELATED APPLICATIONS

This is a §371 of International Application No. PCT/JP2009/054706, with an international filing date of Mar. 5, 2009 (WO 2009/110640 A1, published Sep. 11, 2009), which is based on Japanese Patent Application Nos. 2008-057518, filed Mar. 7, 2008, and 2009-050133, filed Mar. 4, 2009, the subject matter of which is incorporated by reference.

TECHNICAL FIELD

This disclosure relates to Cr containing steels, particularly to ferritic stainless steels that have both high thermal fatigue resistance and oxidation resistance and that are preferably used for exhaust components used under high temperature environments, such as exhaust pipes of automobiles or motorcycles or exhaust air ducts of converter cases or thermal electric power plants.

BACKGROUND

Exhaust components, such as exhaust manifolds, exhaust pipes, converter cases, and mufflers used under the exhaust environment of automobiles, are required to be excellent in terms of thermal fatigue resistance or oxidation resistance (hereinafter, both properties are collectively referred to as "heat resistance"). For applications requiring such heat resistance, Cr containing steels, to which Nb and Si are added, such as Type 429 (14Cr-0.9Si-0.4Nb), are currently used frequently. However, when an exhaust gas temperature increases so as to exceed 900° C. with an improvement in engine performance, the thermal fatigue resistance of the Type 429 becomes insufficient.

To deal with this problem, Cr containing steels whose high temperature proof stress has been improved by adding Nb and Mo, SUS444 (19Cr-0.5Nb-2Mo) specified in JIS G4305, ferritic stainless steels to which Nb, Mo, and W have been added, etc., have been developed (e.g., Japanese Unexamined Patent Application Publication No. 2004-018921). However, due to the unusually steep increase in the price of rare metal raw materials, such as Mo or W, these days, the development of materials having heat resistance equivalent thereto using inexpensive raw materials has been increasingly required.

As materials that are excellent in terms of heat resistance and that do not contain expensive elements, such as Mo and W, for example, WO 2003/004714 pamphlet discloses a ferritic stainless steel for automobile exhaust air passage components in which Nb: 0.50 mass % or lower, Cu: 0.8 to 2.0 mass %, and V: 0.03 to 0.20 mass % are added to 10 to 20 mass % Cr steel, Japanese Unexamined Patent Application Publication No. 2006-117985 discloses a ferritic stainless steel excellent in terms of thermal fatigue resistance in which Ti: 0.05 to 0.30 mass %, Nb: 0.10 to 0.60 mass %, Cu: 0.8 to 2.0 mass %, and B: 0.0005 to 0.02 mass % are added to 10 to 20 mass % Cr steel, and Japanese Unexamined Patent Application Publication No. 2000-297355 discloses ferritic stainless steels for automobile exhaust air parts in which Cu: 1 to 3 mass % are added to 15 to 25 mass % Cr steel. The respective steels have improved thermal fatigue resistance by the addition of Cu.

We found that, when Cu is added as in the techniques of the known publications mentioned above, the fatigue resistance improves, but the oxidation resistance of the steel itself decreases and, thus, the heat resistance generally deteriorates.

It could therefore be helpful to provide a ferritic stainless steel excellent in terms of both oxidation resistance and thermal fatigue resistance without adding expensive elements such as Mo or W by developing a technique for preventing reduction in oxidation resistance by the addition of Cu.

SUMMARY

We thus provide:

1. A ferritic stainless steel containing C, 0.015 mass % or lower, Si: 1.0 mass % or lower, Mn: 1.0 mass % or lower, P: 0.04 mass % or lower, S: 0.010 mass % or lower, Cr: 16 to 23 mass % or lower, N, 0.015 mass % or lower, Nb: 0.3 to 0.65 mass %, Ti: 0.15 mass % or lower, Mo: 0.1 mass % or lower, W: 0.1 mass % or lower, Cu: 1.0 to 2.5 mass %, Al: 0.2 to 1.5 mass %, and a balance of Fe and inevitable impurities.
2. The ferritic stainless steel further contains, in addition to the above-mentioned component composition, one or two or more elements selected from B: 0.003 mass % or lower, REM: 0.08 mass % or lower, Zr: 0.5 mass % or lower, V: 0.5 mass % or lower, Co: 0.5 mass % or lower, and Ni: 0.5 mass % or lower.
3. Preferably, in the ferritic stainless steel, Si is 0.4 to 1.0 mass % in the components according to items 1 or 2.
4. More preferably, in the ferritic stainless steel, Si is in the range of 0.4 to 1.0 mass % and Ti is in the range of 0.01 mass % or lower in the components according to items 1 or 2.

A ferritic stainless steel having heat resistance (thermal fatigue resistance and oxidation resistance) equal to or higher than that of SUS444 can be obtained at low cost without adding expensive Mo or W. Therefore, the steel is preferably used for automobile exhaust components.

DETAILED DESCRIPTION

"Excellent oxidation resistance and thermal fatigue resistance" refers to properties equal to or higher than the properties of SUS444. Specifically, the oxidation resistance refers to an oxidation resistance at 950° C. that is equal to or higher than the oxidation resistance of SUS444 and the thermal fatigue resistance refers to a thermal fatigue resistance between 100 and 850° C. that is equal to or higher than that of SUS444.

We developed a ferritic stainless steel excellent in terms of both oxidation resistance and fatigue resistance without adding an expensive element such as Mo or W while preventing reduction in oxidation resistance due to the addition of Cu, which poses problems in the former techniques. As a result, we found that high high-temperature strength is obtained over a wide temperature range and thermal fatigue resistance is improved by adding Nb in the range of 0.3 to 0.65 mass % and Cu in the range of 1.0 to 2.5 mass %; reduction in oxidation resistance due to the addition of Cu can be prevented by adding an appropriate amount of Al (0.2 to 1.5 mass %); and thus heat resistance equal to or higher than that of SUS444 can be obtained without adding Mo or W only when the amounts of Nb, Cu, and Al are adjusted to be within the above-mentioned appropriate ranges.

We further conducted extensive research on a method for improving oxidation resistance under an environment containing water vapor, which is the environment in which steels are actually intended to be used as an exhaust manifold or the like. As a result, we found that, by selecting the amount of Si (0.4 to 1.0 mass %), the oxidation resistance in a water vapor atmosphere (hereinafter referred to as "water vapor oxidation resistance") is also made equal to or higher than that of SUS444.

First, fundamental experiments will be described.

Figure 1:
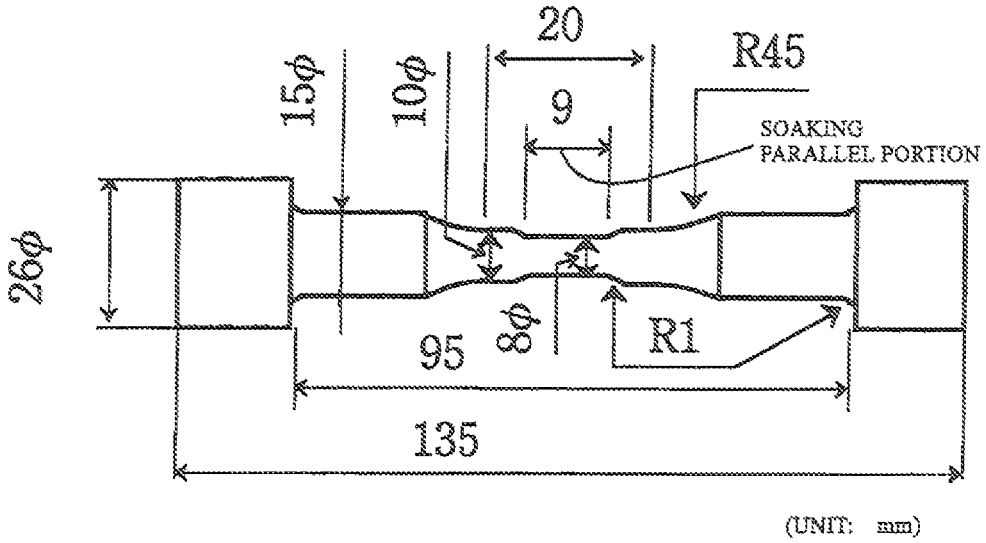
FIG. 1 is a view illustrating a thermal fatigue test specimen.
Figure 2:
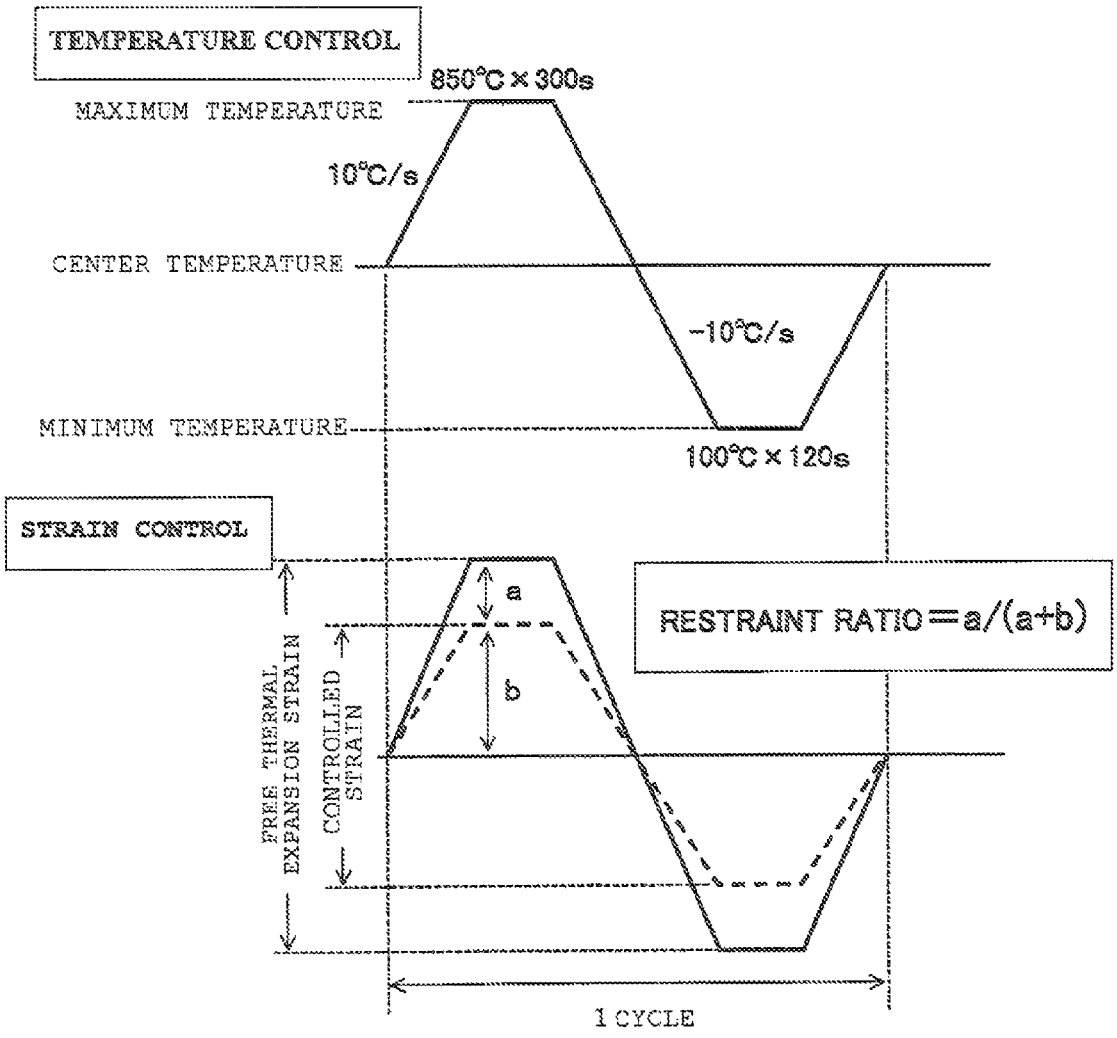
FIG. 2 is a view illustrating temperatures and restraining conditions in a thermal fatigue test.

Steels formed by adding Cu in different amounts in the range of 0 to 3 mass % to a base containing C, 0.005 to 0.007 mass %, N, 0.004 to 0.006 mass %, Si: 0.3 mass %, Mn: 0.4 mass %, Cr: 17 mass %, Nb: 0.45 mass %, and Al: 0.35 mass % were smelted under laboratory conditions to form 50 kg steel ingots. Then, the steel ingots were heated to 1170° C., and hot-rolled to be formed into sheet bars having a thickness of 30 mm and a width of 150 mm. Thereafter, the sheet bars were forged to be formed into bars having a 35 mm×35 mm cross section. The bars were annealed at a temperature of 1030° C., and then machined, thereby manufacturing thermal fatigue test specimens having dimensions as shown in FIG. 1. Then, the test specimens were repeatedly subjected to heat treatment in which heating and cooling were performed between 100° C. and 850° C. at a restraint ratio of 0.35 as shown in FIG. 2, and then the thermal fatigue life was measured. The thermal fatigue life was determined as the smallest number of cycles possible until a stress, which was calculated by dividing a load detected at 100° C. by the cross section of a soaking parallel portion of the test specimen shown in FIG. 1, starts to continuously decrease relative to the stress of a previous cycle. This is equivalent to the number of cycles possible until cracks form in the test specimen. For comparison, the same test was performed for SUS444 (steel containing Cr: 19 mass %, Mo: 2 mass %, and Nb: 0.5 mass %).

Figure 3:
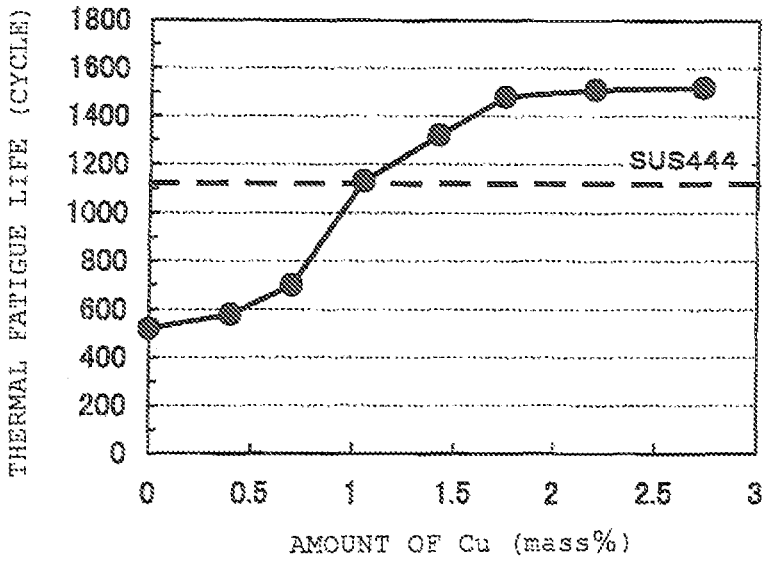
FIG. 3 is a graph illustrating influences of the addition amount of Cu on thermal fatigue resistance.

FIG. 3 shows the results of the thermal fatigue test. FIG. 3 shows that, by adding Cu in an amount higher than 1.0 mass %, a thermal fatigue life equal to or higher than the thermal fatigue life of SUS444 (about 1100 cycles) is obtained, and thus it is effective for improvement of the thermal fatigue resistance to add Cu in an amount of 1 mass % or more.

Next, steels formed by adding Al in different amounts in the range of 0 to 2 mass % to a base containing C, 0.006 mass %, N, 0.007 mass %, Mn: 0.4 mass %, Si: 0.3 mass %, Cr: 17 mass %, Nb: 0.49 mass %, and Cu: 1.5 mass % were smelted under laboratory conditions to form 50 kg steel ingots. Then, the steel ingots were subjected to hot rolling, hot-rolled sheet annealing, cold rolling, and finishing annealing to be formed into cold-rolled annealed sheets having a thickness of 2 mm. 30 mm×20 mm test specimens were cut out from the cold rolled steel sheets obtained as described above. Then, a 4 mmϕ hole was formed in the upper portion of each of the test specimens. Then, the front surface and the end surface of each of the test specimens were polished with #320 emery paper, degreased, and subjected to the following tests.

<Continuous Oxidation Test in Air>

The test specimen was held for 300 hours in an atmospheric air furnace heated to 950° C. Then, the difference in mass of the test specimen between before and after the heating test was measured to determine the weight gain by oxidation ($g/m^2$) per unit area.

Figure 4:
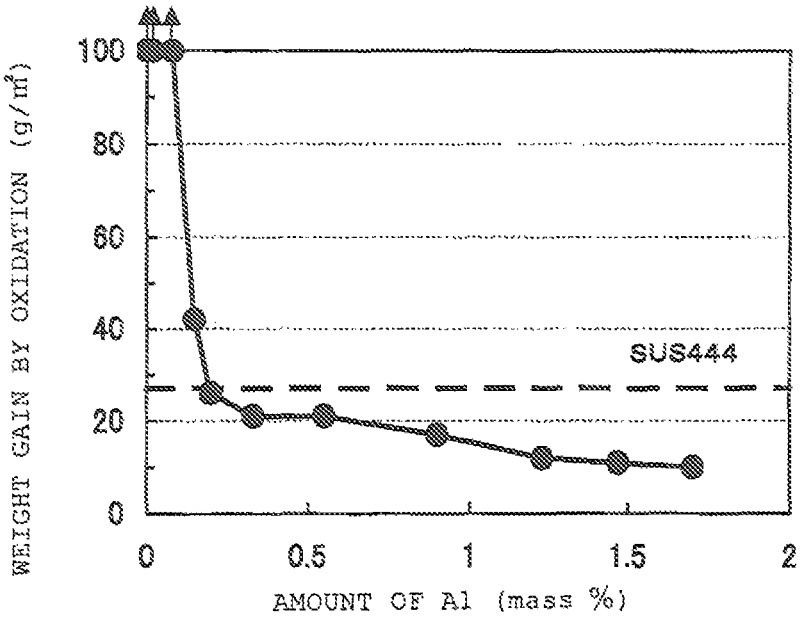
FIG. 4 is a graph illustrating influences of the addition amount of Al on oxidation resistance (weight gain by oxidation).

FIG. 4 shows the relationship between the weight gain by oxidation and the Al content in the oxidation test in the atmospheric air. FIG. 4 shows that, by adding Al in an amount of 0.2 mass % or more, oxidation resistance equal to or higher than that of SUS444 (weight gain by oxidation: 27 $g/m^2$ or lower) is obtained.

Next, steels formed by adding Si in different amounts in the range of 1.2 mass % or lower to a base containing C, 0.006 mass %, N, 0.007 mass %, Mn: 0.2 mass %, Al: 0.45 mass %, Cr: 17 mass %, Nb: 0.49 mass %, and Cu: 1.5 mass % were smelted under laboratory conditions to form 50 kg steel ingots. Then, the steel ingots were subjected to hot rolling, hot-rolled sheet annealing, cold rolling, and finishing annealing to be formed into cold-rolled annealed sheets having a thickness of 2 mm. 30 mm×20 mm test specimens were cut out from the cold rolled steel sheets obtained as described above. Then, a 4 mmϕ hole was formed in the upper portion of each of the test specimens. Then, the front surface and the end surface of each of the test specimens were polished with #320 emery paper, degreased, and subjected to the following continuous oxidation test in a water vapor atmosphere.

<Continuous Oxidation Test in Water Vapor Atmosphere>

The test specimen was held for 300 hours in a furnace heated to 950° C. whose atmosphere was transformed into a water vapor atmosphere by making a bubbling gas containing 7 vol % $CO_2$, 1 vol % $O_2$, and a balance of $N_2$ at 0.5 L/min flow into distilled water maintained at 60° C. Then, the difference in mass of the test specimen between before and after the heating test was measured to determine the weight gain due to oxidation ($g/m^2$) per unit area.

Figure 5:
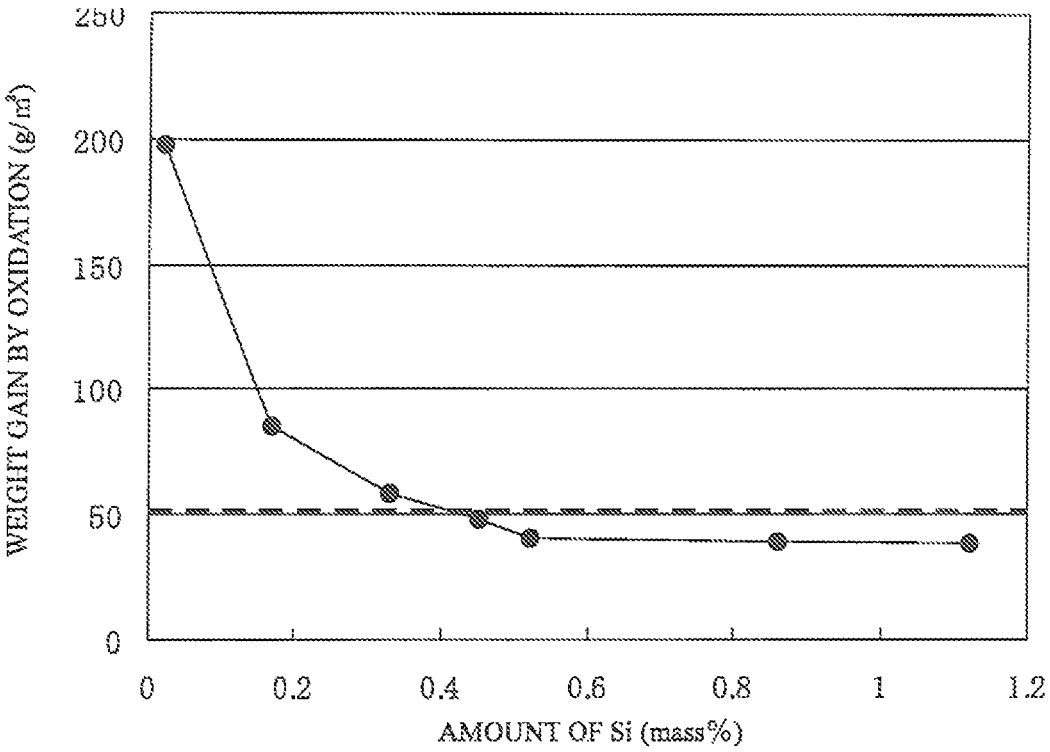
FIG. 5 is a graph illustrating influences of the addition amount of Si on water vapour oxidation resistance (weight gain by oxidation).

FIG. 5 illustrates the relationship between the weight gain by oxidation and the content of Si in the continuous oxidation test in a water vapor atmosphere. FIG. 5 shows that, by adding Si in an amount of 0.4 mass % or more, oxidation resistance equal to or higher than that of SUS444 (weight gain due to oxidation: 51 $g/m^2$ or lower) is obtained.

Next, the component composition of the ferritic stainless steel will be described.

C: 0.015 mass % or lower

C is an element that is effective for increasing the strength of a steel. However, when the C content exceeds 0.015 mass %, reductions in toughness and formability become noticeable. Therefore, the C content is 0.015 mass % or lower. From the viewpoint of securing formability, the C content is preferably lower, and preferably 0.008 mass % or lower. In contrast, to secure strength for exhaust components, the C content is preferably 0.001 mass % or more and more preferably in the range of 0.002 to 0.008 mass %.

Si: 1.0 mass % or lower

Si is an element to be added as a deoxidation material. To obtain the effect, the Si content is preferably 0.05 mass % or more. Moreover, although the Si has an effect of improving oxidation resistance, the effect is not as high as that exerted by Al. In contrast, addition in an excessive amount exceeding 1.0 mass % reduces workability. Therefore, the upper limit of the amount of Si is 1.0 mass %.

However, Si is also an important element that increases oxidation resistance (water vapor oxidation resistance) in a water vapor atmosphere. As shown in FIG. 5, to obtain water vapour oxidation resistance equal to that of SUS444, Si needs to be added in an amount of 0.4 mass % or more. Therefore, when the effect is emphasized, the Si content is preferably in the range of 0.4 mass % or more. More preferably, the Si content is in the range of 0.4 to 0.8 mass %.

The reason Si increases the water vapor oxidation resistance as described above has not been fully elucidated yet. However, we believe that, by adding Si in an amount of 0.4 mass % or more, a dense Si oxide phase is continually formed on the surface of the steel sheet to suppress entering of gas components ($H_2O$, $CO_2$, and $O_2$) from the outside, thereby increasing the water vapor oxidation resistance. When stricter water vapor oxidation resistance is required, the Si content is preferably 0.5 mass % or more.

Mn: 1.0 mass % or lower

Mn is an element that increases the strength of a steel and also acts as a deoxidizer. Thus, Mn is preferably added in an amount of 0.05 mass % or more. However, when Mn is excessively added, a γ-phase is likely to be formed at high temperatures, reducing heat resistance. Therefore, the Mn content is 1.0 mass % or lower. Preferably, the Mn content is 0.7 mass % or lower.

P: 0.040 mass % or lower

P is a harmful element that reduces toughness, and thus the P content is preferably reduced as much as possible. Thus, the P content is 0.040 mass % or lower. Preferably, the P content is 0.030 mass % or lower.

S: 0.010 mass % or lower

Since S is also a harmful element that reduces elongation and an r value, adversely affects formability, and reduces corrosion resistance which is one of the basic properties of a stainless steel, the S content is preferably reduced as much as possible. Therefore, the S content is 0.010 mass % or lower. Preferably, the S content is 0.005 mass % or lower.

Cr: 16 to 23 mass %

Cr is an important element effective for increasing corrosion resistance and oxidation resistance, which are features of a stainless steel. However, when the Cr content is lower than 16 mass %, sufficient oxidation resistance is not obtained. In contrast, Cr is an element that solid-solution strengthens a steel at room temperature, hardens a steel, and reduces the ductility of a steel. In particular, when Cr is added in an amount exceeding 23 mass %, the adverse effects become noticeable. Thus, the upper limit of the Cr content is 23 mass %. Therefore, the Cr content is in the range of 16 to 23 mass %. More preferably, the Cr content is in the range of 16 to 20 mass %.

N, 0.015 mass % or lower

N is an element that reduces the toughness and formability of a steel. When N is added in an amount exceeding 0.015 mass %, the reduction becomes noticeable. Therefore, the N content is 0.015 mass % or lower. From the viewpoint of securing toughness and formability, the N content is reduced as much as possible and the N content is preferably lower than 0.010 mass %.

Nb: 0.3 to 0.65 mass %

Nb is an element that has actions of forming a carbon nitride together with C and N for fixing, increasing corrosion resistance or formability, or grain boundary corrosion resistance of a weld zone, and increasing high temperature strength to improve thermal fatigue resistance. Such effects are observed when Nb is added in an amount of 0.3 mass % or more. In contrast, when Nb is added in an amount exceeding 0.65 mass %, a Laves phase is likely to precipitate, accelerating embrittlement. Thus, the Nb content is in the range of 0.3 to 0.65 mass %. Preferably, the Nb content is in the range of 0.4 to 0.55 mass %.

Ti: 0.15 mass % or lower

Ti has actions of fixing C and N to increase corrosion resistance or formability, or grain boundary corrosion resistance of a weld zone similarly to Nb. However, such effects are saturated in the component system containing Nb when the Ti content exceeds 0.15 mass % and a steel is hardened due to solid solution hardening. Thus, the upper limit of the Ti content is 0.15 mass %.

Ti is an element which does not need to be positively particularly added. However, Ti is more likely to combine with N compared with Nb, and is likely to form coarse TiN. The coarse TiN would likely serve as a cause of the development of cracks, and reduce the toughness of a hot-rolled sheet. Therefore, when higher toughness is required, the Ti content is preferably limited to 0.01 mass % or lower.

Mo: 0.1 mass % or lower

Mo is an expensive element, and thus is not positively added. However, 0.1 mass % or lower of Mo is sometimes intermixed from scrap as a raw material. Therefore, the Mo content is 0.1 mass % or lower.

W: 0.1 mass % or lower

W is an expensive element similarly to Mo, and thus is not positively added. However, 0.1 mass % or lower of W is sometimes intermixed from scrap as a raw material. Therefore, the W content is 0.1 mass % or lower.

Cu: 1.0 to 2.5 mass %

Cu is an element that is very effective for improvement of thermal fatigue resistance. As shown in FIG. 3, to obtain thermal fatigue resistance equal to or higher than that of SUS444, Cu needs to be added in an amount of 1.0 mass % or more. However, when Cu is added in an amount exceeding 2.5 mass %, ε-Cu precipitates during cooling after heat treatment, thereby hardening the steel and easily causing embrittlement during hot working. It is more important that the addition of Cu increases the thermal fatigue resistance of the steel, but reduces the oxidation resistance of the steel itself, and generally reduces the heat resistance thereof. The cause thereof has not been fully elucidated yet. However, we believe that Cu becomes concentrated in a Cr-removed layer directly below generated scales, thereby suppressing rediffusion of Cr that is an element that improves the oxidation resistance inherent to a stainless steel. Therefore, the Cu content is in the range of 1.0 to 2.5 mass %. More preferably, the Cu content is in the range of 1.1 to 1.8 mass %.

Al: 0.2 to 1.5 mass %

Al is an indispensable element for improving the oxidation resistance of a Cu-added steel as shown in FIG. 4. In particular, to obtain oxidation resistance equal to or higher than that of SUS444, Al needs to be added in an amount of 0.2 mass % or more. In contrast, when Al is added in an amount exceeding 1.5 mass %, the steel is hardened, thereby reducing workability. Thus, the upper limit is 1.5 mass %. Therefore, the Al content is in the range of 0.2 to 1.5 mass %. When used at higher temperatures, the Al content is preferably in the range of 0.3 to 1.0 mass %.

Al is also an element that dissolves at high temperatures and solid-solution strengthens a steel. In particular, an effect of increasing the strength of a steel at temperatures exceeding 800° C. is large. However, as described above, when the addition amount of Si is insufficient, gas components entering a steel and Al are bonded to each other, and thus Al does not effectively contribute as a solid-solution strengthening element. Therefore, to sufficiently develop the above-described effect of Al in a water vapor atmosphere, Si is preferably added in an amount of 0.4 mass % or more.

The ferritic stainless steel may further contain, in addition to the above-mentioned essential ingredients, one or two or more elements selected from B, REM, Zr, V, Co, and Ni in the following ranges.

B: 0.003 mass % or lower

B is an element that is effective for increasing workability, particularly secondary workability. The effect is noticeable when B is added in an amount of 0.0005 mass % or more. However, the addition of B in an amount exceeding 0.003 mass % generates BN and reduces workability. Therefore, when B is added, the addition amount is 0.003 mass % or lower. More preferably, the addition amount of B is in the range of 0.0005 to 0.002 mass %.

REM: 0.08 mass % or lower, Zr: 0.5 mass % or lower

Each of REMs (rare earth metals) and Zr are elements that improve oxidation resistance. To obtain the effect, each of an REM and Zr are preferably added in an amount of 0.01 mass % or more and 0.05 mass % or more, respectively. However, the addition of an REM in an amount exceeding 0.08 mass % causes embrittlement of the steel and the addition of Zr in an amount exceeding 0.50 mass % precipitates a Zr intermetallic compound to cause embrittlement of the steel. Therefore, an REM is added in an amount of 0.08 mass % or lower and Zr is added in an amount of 0.5 mass % or lower.

V: 0.5 mass % or lower

V is an element that is effective for improvement of workability. In particular, to obtain the effect of improving oxidation resistance, V is preferably added in an amount of 0.15 mass % or more. However, when V is excessively added in an amount exceeding 0.5 mass %, coarse V (C, N) is precipitated, thereby deteriorating the surface quality of the steel sheet. Therefore, V is added preferably in an amount of 0.50 mass % or lower and more preferably in the range of 0.15 to 0.4 mass %.

Co: 0.5 mass % or lower

Co is an element that is effective for improvement of toughness, and is preferably added in an amount of 0.02 mass % or more. However, Co is an expensive element. Even when Co is added in an amount exceeding 0.5 mass %, the effect is saturated. Therefore, Co is preferably added in an amount of 0.5 mass % or lower. More preferably, Co is added in the range of 0.02 to 0.2 mass %.

Ni: 0.5 mass % or lower

Ni is an element for increasing toughness. To obtain the effect, Ni is preferably added in an amount of 0.05 mass % or more. However, Ni is expensive. Moreover, since Ni is a powerful γ-phase formation element, Ni forms a γ-phase at high temperatures, thereby reducing oxidation resistance. Therefore, Ni is added in an amount of 0.5 mass % or lower. More preferably, Ni is added in the range of 0.05 to 0.4 mass %.

Next, a method for producing a ferritic stainless steel will be described.

As a method for producing the stainless steel, any method can be preferably used without limitation insofar as the method is a common method for producing a ferritic stainless steel. For example, the method preferably, for example, includes: smelting a steel in a known melting furnace, such as a converter or an electric furnace, or further performing secondary refining, such as ladle refining or vacuum refining, to form a steel having the above-mentioned component composition; forming the molten steel into a slab by a continuous casting process or an ingot making-blooming process; subjecting the resultant to hot rolling to form a hot-rolled sheet; annealing the hot-rolled sheet as required; washing the hot-rolled sheet with acid; cold rolling the resultant; subjecting the resultant to finish annealing; and washing the resultant with acid, thereby obtaining a cold-rolled annealed sheet. The cold rolling process may be performed once or twice or more with intermediate annealing performed between the cold rolling processes and each process of cold rolling, finish annealing, and acid washing may be repeatedly performed. Furthermore, depending on the case, the annealing process of the hot-rolled sheet may be omitted. When the steel sheet surface is required to be glossy, skin passing may be performed after the cold rolling or the finish annealing. It is preferable that a slab heating temperature before the hot rolling be in the range of 1000 to 1250° C., that a hot-rolled sheet annealing temperature be in the range of 900 to 1100° C., and that a finish annealing temperature be in the range of 900 to 1120° C.

The ferritic stainless steel obtained as described above is subjected to cutting, bending, pressing, or the like in accordance with the application to be formed into various exhaust components used under high temperature environments, such as exhaust pipes of automobiles or motorcycles or exhaust air ducts of converter cases or thermal electric power plants. The stainless steel used for the above-mentioned components is not limited to a cold-rolled annealed sheet, and may be used as a hot-rolled sheet or hot-rolled annealed sheet and, further, may be subjected to descaling treatment, as required, for use. There is no limitation on a welding process for obtaining the above-mentioned components, and usual arc welding, such as MIG (Metal Inert Gas), MAG (Metal Active Gas), or TIG (Tungsten Inert Gas); electric resistance welding, such as spot welding or seam welding; high-frequency resistance welding, high-frequency induction welding, or laser welding used for electric resistance welding; or the like can be used.

Example 1

Steels No. 1 to No. 24 each having any one of the component compositions shown in Tables 1-1 and 1-2 were smelted in a vacuum melting furnace, and cast into a 50 kg steel ingot. The steel ingot was forged, and then halved. Thereafter, either one of the halved steel ingot was heated to 1170° C., and hot-rolled to obtain a hot-rolled sheet 5 mm in thickness. Then, the hot-rolled sheet was annealed at a temperature of 1020° C., washed with acid, cold-rolled at a rolling reduction of 60%, subjected to finish annealing at a temperature of 1030° C., cooled at an average cooling rate of 20° C./sec, and washed with acid to obtain a cold-rolled sheet 2 mm in thickness. Then, the cold-rolled sheet was subjected to the following two kinds of oxidation resistance tests. For reference, also with respect to SUS444 and steels disclosed in WO 2003/004714 pamphlet and Japanese Unexamined Patent Application Publication Nos. 2006-117985 and 2000-297355 which are indicated as No. 25 to No. 28 of Table 1, cold-rolled annealed sheets were produced in the same manner as above, and then subjected to the following continuous oxidation test in the air and continuous oxidation test in a water vapour atmosphere.

<Continuous Oxidation Test in Air>

Samples (30 mm×20 mm) were cut out from various cold-rolled annealed sheets obtained as described above. Then, a 4 mmϕ hole was formed in the upper portion of each sample. The front surface and the end surface were polished with #320 emery paper, and degreased. Thereafter, the resultant was suspended in an atmospheric air furnace heated to 950° C., and held for 300 hours. After the test, the sample mass was measured to determine a difference from the sample mass before the test previously measured, thereby calculating weight gain by oxidation ($g/m^2$). Each test was carried out twice, and the continuous oxidation resistance was evaluated based on the average value of the tests.

<Continuous Oxidation Test in Water Vapor Atmosphere>

Samples (30 mm×20 mm) were cut out from various cold-rolled annealed sheets obtained as described above. Then, a 4 mmϕ hole was formed in the upper portion of each sample. The front surface and the end surface were polished with #320 emery paper, and degreased. The sample was held for 300 hours in a furnace heated to 950° C. whose atmosphere was transformed into a water vapor atmosphere by flowing bubbling gas containing 7 vol % $CO_2$, 1 vol % $O_2$, and the balance $N_2$ at 0.5 L/min into distilled water maintained at 60° C. After the test, the sample mass was measured to determine a difference from the sample mass before the test previously measured, thereby calculating weight gain by oxidation ($g/m^2$). Each test was carried out twice, and the continuous oxidation resistance was evaluated based on the average value of the tests.

Example 2

The remaining steel ingot of the 50 kg steel ingot halved in Example 1 was heated to 1170° C., and hot-rolled to be formed into a sheet bar having a thickness of 30 mm and a width of 150 mm. Thereafter, the sheet bar was forged to be formed into a bar having a 35 mm×35 mm cross section. The bar was annealed at a temperature of 1030° C., and then machined to be formed into a thermal fatigue test specimen having a dimension shown in FIG. 1. Then, the test specimen was subjected to the following thermal fatigue test. As Reference Examples, in the same manner as in Example 1, also with respect to steels disclosed in WO 2003/004714 pamphlet and Japanese Unexamined Patent Application Publication Nos. 2006-117985 and 2000-297355 and SUS444, samples were produced in the same manner as above, and then subjected to a thermal fatigue test.

<Thermal Fatigue Test>

In a thermal fatigue test, rise and fall in temperature was repeated between 100° C. and 850° C. at a restraint ratio of 0.35, and then the thermal fatigue life was measured. During the test, the heating rate and the cooling rate were adjusted to 10° C./sec, respectively, and the holding time at 100° C. was adjusted to 2 min and the holding time at 850° C. was adjusted to 5 min. The thermal fatigue life was determined as the smallest number of cycles when a stress, which was calculated by dividing a load detected at 100° C. by the cross section of a thermal-equilibrium portion of the test specimen, starts to continuously decrease relative to the stress of a previous cycle.

The results of the continuous oxidation test in the air and the continuous oxidation test in a water vapor atmosphere of Example 1 and the results of the thermal fatigability resistance test of Example 2 were collectively shown in Table 2. As is clear from Table 2, each steel of Invention Examples has oxidation resistance and thermal fatigue resistance equal to or higher than those of SUS444. In contrast, the steels of Comparative Examples Reference Examples that are outside the scope of this disclosure are not excellent in terms of both oxidation resistance and thermal fatigue resistance.

INDUSTRIAL APPLICABILITY

Our steel can be preferably used not only as exhaust components of automobiles or the like but also as exhaust components of thermal electric power systems or solid acid components for fuel cells requiring similar properties.

TABLE 1-1

| Steel | Chemical component (mass %) | | | | | | | | | | | | | | |
|---|---|---|---|---|---|---|---|---|---|---|---|---|---|---|---|
| No. | C | Si | Mn | Al | P | S | Cr | Cu | Nb | Ti | Mo | W | N | Other | Remarks |
| 1 | 0.006 | 0.19 | 0.13 | 0.37 | 0.032 | 0.004 | 17.5 | 1.35 | 0.43 | 0.006 | 0.02 | 0.04 | 0.008 | — | Invention Example |
| 2 | 0.005 | 0.35 | 0.28 | 0.51 | 0.026 | 0.002 | 17.3 | 1.56 | 0.41 | 0.002 | 0.03 | 0.01 | 0.007 | — | Invention Example |
| 3 | 0.008 | 0.09 | 0.63 | 1.12 | 0.029 | 0.003 | 16.2 | 1.42 | 0.46 | 0.051 | 0.04 | 0.01 | 0.008 | — | Invention Example |
| 4 | 0.004 | 0.45 | 0.22 | 0.32 | 0.033 | 0.005 | 19.3 | 1.92 | 0.36 | 0.12 | 0.02 | 0.03 | 0.007 | — | Invention Example |
| 5 | 0.011 | 0.82 | 0.41 | 0.72 | 0.020 | 0.002 | 17.1 | 1.21 | 0.44 | 0.009 | 0.04 | 0.02 | 0.004 | — | Invention Example |
| 6 | 0.005 | 0.27 | 0.33 | 0.48 | 0.022 | 0.001 | 17.7 | 1.46 | 0.48 | 0.006 | 0.02 | 0.01 | 0.011 | — | Invention Example |
| 7 | 0.004 | 0.19 | 0.33 | 0.39 | 0.029 | 0.002 | 21.6 | 1.77 | 0.39 | 0.005 | 0.01 | 0.01 | 0.008 | — | Invention Example |
| 8 | 0.007 | 0.17 | 0.23 | 0.47 | 0.029 | 0.003 | 17.2 | 1.39 | 0.45 | 0.004 | 0.01 | 0.01 | 0.008 | B/0.0009<br>V/0.051 | Invention Example |
| 9 | 0.006 | 0.41 | 0.09 | 0.66 | 0.033 | 0.001 | 18.2 | 1.61 | 0.40 | 0.09 | 0.05 | 0.01 | 0.009 | REM/0.013<br>Ni/0.33 | Invention Example |
| 10 | 0.008 | 0.37 | 0.71 | 0.88 | 0.018 | 0.003 | 17.8 | 1.28 | 0.52 | 0.002 | 0.01 | 0.02 | 0.007 | Co/0.04<br>Zr/0.06 | Invention Example |
| 11 | 0.006 | 0.31 | 0.35 | 0.14 | 0.030 | 0.002 | 17.1 | 1.46 | 0.44 | 0.006 | 0.01 | 0.02 | 0.009 | — | Comparative Example |
| 12 | 0.006 | 0.32 | 0.55 | 0.69 | 0.028 | 0.003 | 17.4 | 0.87 | 0.51 | 0.004 | 0.02 | 0.01 | 0.009 | — | Comparative Example |
| 13 | 0.007 | 0.23 | 0.25 | 0.47 | 0.027 | 0.002 | 17.6 | 1.18 | 0.44 | 0.003 | 0.06 | 0.02 | 0.008 | V: 0.18 | Invention Example |
| 14 | 0.003 | 0.09 | 0.12 | 0.46 | 0.025 | 0.003 | 17.5 | 1.26 | 0.42 | 0.008 | 0.05 | 0.03 | 0.007 | V: 0.22 | Invention Example |
| 15 | 0.008 | 0.15 | 0.39 | 0.51 | 0.021 | 0.001 | 17.3 | 1.38 | 0.48 | 0.024 | 0.02 | 0.06 | 0.008 | V: 0.29 | Invention Example |
| 16 | 0.006 | 0.32 | 0.34 | 0.46 | 0.024 | 0.002 | 17.7 | 1.22 | 0.46 | 0.005 | 0.06 | 0.02 | 0.005 | V: 0.38 | Invention Example |
| 17 | 0.009 | 0.18 | 0.15 | 0.49 | 0.027 | 0.004 | 17.4 | 1.48 | 0.47 | 0.014 | 0.04 | 0.03 | 0.006 | V: 0.44 | Invention Example |
| 18 | 0.007 | 0.27 | 0.15 | 0.53 | 0.027 | 0.003 | 19.1 | 1.28 | 0.45 | 0.004 | 0.05 | 0.02 | 0.007 | V: 0.20 | Invention Example |
| 19 | 0.005 | 0.03 | 0.11 | 0.51 | 0.024 | 0.002 | 18.2 | 1.19 | 0.45 | 0.006 | 0.05 | 0.03 | 0.006 | V: 0.23 | Invention Example |

TABLE 1-2

| Steel | Chemical component (mass%) | | | | | | | | | | | | | | |
|---|---|---|---|---|---|---|---|---|---|---|---|---|---|---|---|
| No. | C | Si | Mn | Al | P | S | Cr | Cu | Nb | Ti | Mo | W | N | Other | Remarks |
| 20 | 0.007 | 0.86 | 0.18 | 0.25 | 0.028 | 0.003 | 17.4 | 1.47 | 0.5 | 0.006 | 0.03 | 0.03 | 0.006 | V: 0.04 | Invention Example |
| 21 | 0.006 | 0.45 | 0.23 | 0.44 | 0.033 | 0.004 | 17 | 1.53 | 0.47 | 0.004 | 0.01 | 0.04 | 0.005 | V: 0.08 | Invention Example |
| 22 | 0.007 | 0.73 | 0.11 | 0.89 | 0.025 | 0.002 | 17.9 | 1.71 | 0.39 | 0.002 | 0.01 | 0.02 | 0.007 | V: 0.34 | Invention Example |
| 23 | 0.008 | 0.52 | 0.21 | 0.39 | 0.03 | 0.004 | 17.1 | 1.45 | 0.48 | 0.003 | 0.02 | 0.02 | 0.008 | V: 0.06 | Invention Example |
| 24 | 0.008 | 0.94 | 0.34 | 0.65 | 0.018 | 0.001 | 18.5 | 1.21 | 0.43 | 0.007 | 0.01 | 0.03 | 0.006 | V: 0.19 | Invention Example |
| 25 | 0.008 | 0.31 | 0.42 | 0.019 | 0.031 | 0.003 | 18.7 | 0.02 | 0.52 | 0.003 | 1.87 | 0.02 | 0.008 | — | SUS444 |
| 26 | 0.008 | 0.32 | 0.05 | 0.01 | 0.028 | 0.002 | 17.02 | 1.93 | 0.33 | 0.002 | 0.01 | 0.02 | 0.010 | Ni/0.10<br>V/0.10 | Reference Example I |

TABLE 1-2-continued

| Steel No. | Chemical component (mass%) C | Si | Mn | Al | P | S | Cr | Cu | Nb | Ti | Mo | W | N | Other | Remarks |
|---|---|---|---|---|---|---|---|---|---|---|---|---|---|---|---|
| 27 | 0.009 | 0.46 | 0.54 | 0.002 | 0.029 | 0.003 | 18.90 | 1.36 | 0.35 | 0.08 | 0.01 | 0.02 | 0.007 | Ni/0.10 V/0.03 B/0.0030 | Reference Example 2 |
| 28 | 0.006 | 0.22 | 0.05 | 0.052 | 0.005 | 0.0052 | 18.8 | 1.65 | 0.42 | 0.09 | 0.02 | 0.02 | 0.006 | Ni/0.15 | Reference Example 3 |

(Notes)
Reference Example 1: Steel No. 3 of the invention of WO 2003/004714
Reference Example 2: Steel No. 7 of the invention of Japanese Unexamined Patent Application Publication No. 2006-117985
Reference Example 3: Steel No. 5 of the invention of Japanese Unexamined Patent Application Publication No. 2000-297355

TABLE 2

| Steel No. | Gain weight due to oxidation ($g/m^2$) | Thermal fatigue life (times) | Water vapour oxidation ($g/m^2$) | Remarks |
|---|---|---|---|---|
| 1 | 21 | 1230 | 82 | Invention Example |
| 2 | 20 | 1330 | 55 | Invention Example |
| 3 | 16 | 1270 | >100 | Invention Example |
| 4 | 22 | 1500 | 49 | Invention Example |
| 5 | 18 | 1210 | 40 | Invention Example |
| 6 | 21 | 1300 | 66 | Invention Example |
| 7 | 21 | 1450 | 80 | Invention Example |
| 8 | 21 | 1260 | 85 | Invention Example |
| 9 | 18 | 1390 | 50 | Invention Example |
| 10 | 17 | 1210 | 53 | Invention Example |
| 11 | 80 | 1290 | 79 | Comparative Example |
| 12 | 14 | 820 | 58 | Comparative Example |
| 13 | 15 | 1200 | 71 | Invention Example |
| 14 | 15 | 1230 | >100 | Invention Example |
| 15 | 14 | 1260 | 79 | Invention Example |
| 16 | 14 | 1210 | 57 | Invention Example |
| 17 | 14 | 1310 | 78 | Invention Example |
| 18 | 15 | 1240 | 56 | Invention Example |
| 19 | 15 | 1210 | >100 | Invention Example |
| 20 | 25 | 1300 | 39 | Invention Example |
| 21 | 21 | 1350 | 48 | Invention Example |
| 22 | 13 | 1430 | 34 | Invention Example |
| 23 | 22 | 1280 | 41 | Invention Example |
| 24 | 12 | 1260 | 37 | Invention Example |
| 25 | 27 | 1120 | 51 | SUS444 |
| 26 | >100 | 1480 | >100 | Reference Example 1 |
| 27 | >100 | 1240 | >100 | Reference Example 2 |
| 28 | >100 | 1400 | >100 | Reference Example 3 |

(Notes)
Reference Example 1: Steel No. 3 of the invention of WO 2003/004714
Reference Example 2: Steel No. 7 of the invention of Japanese Unexamined Patent Application Publication No. 2006-117985
Reference Example 3: Steel No. 5 of the invention of Japanese Unexamined Patent Application Publication No. 2000-297355

The invention claimed is:

1. A ferritic stainless steel, comprising: C: 0.015 mass % or less, Si: 1.0 mass % or less, Mn: 1.0 mass % or less, P: 0.04 mass % or less, S: 0.010 mass % or less, Cr: 16 to 23 mass %, N: 0.015 mass % or less, Nb: 0.3 to 0.65 mass %, Ti: 0.002 to 0.15 mass %, Mo: 0.1 mass % or less, W: present in an amount up to and including 0.1 mass %, Cu: 1.0 to 2.5 mass %, Al: 0.2 to 1.5 mass %, Ni: 0.05 to 0.5%, V: present in an amount up to 0.5%, and a balance of Fe and inevitable impurities, and having an oxidation weight gain of 27 $g/m^2$ or less when held for 300 hours in atmospheric air heated to 950° C. in a furnace.

2. The ferritic stainless steel according to claim 1, further comprising one or more elements selected from the group consisting of B: 0.003 mass % or less, REM: 0.08 mass % or less, Zr: 0.5 mass % or less, and Co: 0.5 mass % or less.

3. The ferritic stainless steel according to claim 2 comprising Si in an amount of 0.4 to 1.0 mass %.

4. The ferritic stainless steel according to claim 2 comprising Si in an amount of 0.4 to 1.0 mass % and Ti in an amount of 0.01 mass % or less.

5. The ferritic stainless steel according to claim 1 comprising Si in an amount of 0.4 to 1.0 mass %.

6. The ferritic stainless steel according to claim 1 comprising Si in an amount of 0.4 to 1.0 mass % and Ti in an amount of 0.01 mass % or less.

7. The ferritic stainless steel according to claim 1, further comprising Co: 0.02 to 0.5° h.

8. The ferritic stainless steel according to claim 1, further comprising B: 0.0005 to 0.003%.

9. The ferritic stainless steel according to claim 1, further comprising Co: 0.02 to 0.5% and B: 0.0005 to 0.003%.

10. A ferritic stainless steel, comprising: C: 0.015 mass % or less, Si: 1.0 mass % or less, Mn: 1.0 mass % or less, P: 0.04 mass % or less, S: 0.010 mass % or less lower, Cr: 16 to 23 mass %, N: 0.015 mass % or less lower, Nb: 0.3 to 0.65 mass %, Ti: 0.002 to 0.15 mass %, Mo: present in an amount up to and including 0.1 mass %, B: up to 0.003%, Cu: 1.0 to 2.5 mass %, Al: 0.2 to 1.5 mass %, Ni: 0.04 to 0.4 mass %, V: present in an amount up to 0.5%, Co: 0.02 to 0.5 mass %, and a balance of Fe and inevitable impurities, and having an oxidation weight gain of 27 g/m$^2$ or less when held for 300 hours in atmospheric air heated to 950° C. in a furnace.

11. A ferritic stainless steel, comprising: C: 0.015 mass % or less, Si: 1.0 mass % or less, Mn: 1.0 mass % or less, P: 0.04 mass % or less, S: 0.010 mass % or less lower, Cr: 16 to 23 mass %, N: 0.015 mass % or less lower, Nb: 0.3 to 0.65 mass %, Ti: 0.002 to 0.15 mass %, Mo: present in an amount up to and including 0.1 mass %, Co: 0.02 to 0.5%, Cu: 1.0 to 2.5 mass %, Al: 0.2 to 1.5 mass %, Ni: 0.04 to 0.4 mass %, V: present in an amount up to 0.5%, and a balance of Fe and inevitable impurities, and having an oxidation weight gain of 27 g/m$^2$ or less when held for 300 hours in atmospheric air heated to 950° C. in a furnace.

* * * * *